US005253284A

United States Patent [19]

Kim

[11] Patent Number: 5,253,284

[45] Date of Patent: Oct. 12, 1993

[54] X-RAY TUBE NOISE REDUCTION USING NON-GLASS INSERTS

[75] Inventor: Jeung T. Kim, Daejon, Rep. of Korea

[73] Assignee: General Electric Company, Schenectady, N.Y.

[21] Appl. No.: 891,007

[22] Filed: Jun. 1, 1992

[51] Int. Cl.[5] ..... H01J 5/00

[52] U.S. Cl. ..... 378/121; 378/125; 378/201; 313/317

[58] Field of Search ..... 378/199, 200, 201, 202, 378/121, 125, 127, 130, 139, 141; 313/634, 317; 220/21 R

[56] References Cited

U.S. PATENT DOCUMENTS

| | | | |
|---|---|---|---|
| 4,019,080 | 4/1977 | Besson | 313/317 |
| 4,433,432 | 2/1984 | Nii et al. | 378/202 |
| 4,935,948 | 6/1990 | Kim | 378/125 |

*Primary Examiner*—David P. Porta
*Attorney, Agent, or Firm*—Patrick R. Scanlon; Paul R. Webb, II

[57] ABSTRACT

Noise is reduced in an X-ray tube by inserting a non-glass insert between sections of the glass vacuum tube. The non-glass insert has an impedance which is significantly different than the impedance of the glass tube sections. This impedance mismatch inhibits vibration energy from passing from one glass section to the other. In addition to having a different impedance than the glass sections, the non-glass insert can be made of a heavier material, thus presenting sufficient mass to dissipate vibration energy. The non-glass insert is connected to the glass sections by a pair of connecting members, each of which has a coefficient of thermal expansion closely matching that of the glass sections. Each connecting member has a ring with an annular flange extending perpendicularly therefrom. The ring of each connecting member is attached a respective one of the glass sections and each flange is attached to the insert. Alternatively, the non-glass insert can be inserted between an end of the vacuum tube and its support structure.

22 Claims, 7 Drawing Sheets

X-RAY TUBE NOISE REDUCTION USING NON-GLASS INSERTS

CROSS REFERENCES TO RELATED APPLICATIONS

This application is related to copending application entitled "X-ray Tube Noise Reduction Using an Oil Substitute", Ser. No. 07/891,008, and copending application entitled "X-ray Tube Noise Reduction Using Stator Mass", Ser. No. 07/891,023, both filed concurrently herewith and assigned to the same assignee as the present invention.

BACKGROUND OF THE INVENTION

This invention relates generally to X-ray tubes and more particularly concerns adding a non-glass insert to the vacuum tube of an X-ray tube to reduce the noise produced by the X-ray tube.

The use of X-ray tubes for medical diagnostics is quite common. Unfortunately, an X-ray tube operating at a steady state condition generates significant levels of high frequency noise. The sound pressure may vary from one X-ray tube design to another, but is often in the range of 65–75 decibels and can be even higher. This level is typically 10–20 dB higher than the background noise level in a common medical environment. Thus X-ray tube noise is a problem because the current noise levels are not only a general annoyance to patients, doctors and medical personnel but also makes patient-doctor communications difficult.

A conventional X-ray tube comprises a vacuum tube mounted within an outer casing. The remaining interior space of the casing is filled with oil. The oil dissipates heat generated in the vacuum tube and serves as a dielectric or electrical insulator. The vacuum tube includes a target which is bombarded with electrons emitted from an electron emitter. The electrons cause the target to emit X-ray radiation. In order to prevent its rapid deterioration, the target is rotated at approximately 10,000 RPM. To accomplish this rotation, the target is mounted to a rotatable shaft which is coupled to the vacuum tube via bearings. The rotation of the target generates vibration which is transmitted through the bearings to the vacuum tube. Since the oil is essentially incompressible, the vibration is readily transmitted from the vacuum tube to the outer casing with little attenuation. When the vibration energy is received by the casing, the casing radiates sound to the ambient. The casing is very thick and has a non-uniform spatial distribution so that the chances to reduce sound radiation from the casing are very limited. Although the vibration energy transmitted to the casing could be reduced by lowering the rotational speed of the target, this would severely shorten the life expectancy of the target unless the X-ray power was lowered in accordance with the lowered rotational speed. However, lowering the X-ray power would sacrifice the quality of the image.

One means for reducing X-ray tube noise without shortening target life expectancy or sacrificing image quality is described in U.S. Pat. No. 4,935,948, issued Jun. 19, 1990 to Jeung T. Kim. U.S. Pat. No. 4,935,948 discloses attaching a ring mass on or near the bearing shroud which physically connects the rotor bearings to the vacuum tube. The ring mass dissipates the vibrational energy which would otherwise be transmitted from the rotor bearing to the vacuum tube and on to the casing. Thus, the addition of the ring mass reduces the total noise produced by the X-ray tube. The use of a ring mass, which weighs about two pounds or more, significantly increases the overall weight of the X-ray tube. Furthermore, if made of an electrically conductive material, the ring mass creates an electrical flashover problem because it is located near the very high voltage region within the X-ray tube.

SUMMARY OF THE INVENTION

Accordingly, it is an object of the present invention to provide a means for reducing noise in an X-ray tube.

More specifically, it is an object of the present invention to reduce X-ray tube noise by using a non-glass insert to the vacuum tube.

In addition, it is an object of the present invention to reduce X-ray tube noise without creating electrical flashover.

It is another object of the present invention to provide a means for reducing noise in an X-ray tube which requires few additional parts beyond those in the standard X-ray tube.

These and other objects are accomplished in the present invention by providing a non-glass insert which inhibits transmission of vibration in the vacuum tube of an X-ray tube. The vacuum tube can comprise two sections between which the insert is located, or the insert can be positioned between the vacuum tube and its supporting structure. The non-glass insert has an impedance which is significantly different than the impedance of the glass tube sections. This impedance mismatch inhibits vibration energy from passing from one glass section to the other. In addition to having a different impedance than glass, the non-glass insert can be made of a heavier material to better dissipate vibration energy.

The non-glass insert is connected to the glass sections by a pair of connecting members, each of which has a coefficient of thermal expansion closely matching the coefficient of thermal expansion of the glass sections. Each connecting member comprises a ring having an annular flange extending perpendicularly therefrom, wherein the ring of each connecting member is attached to a respective one of the glass sections and each flange is attached to the insert.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
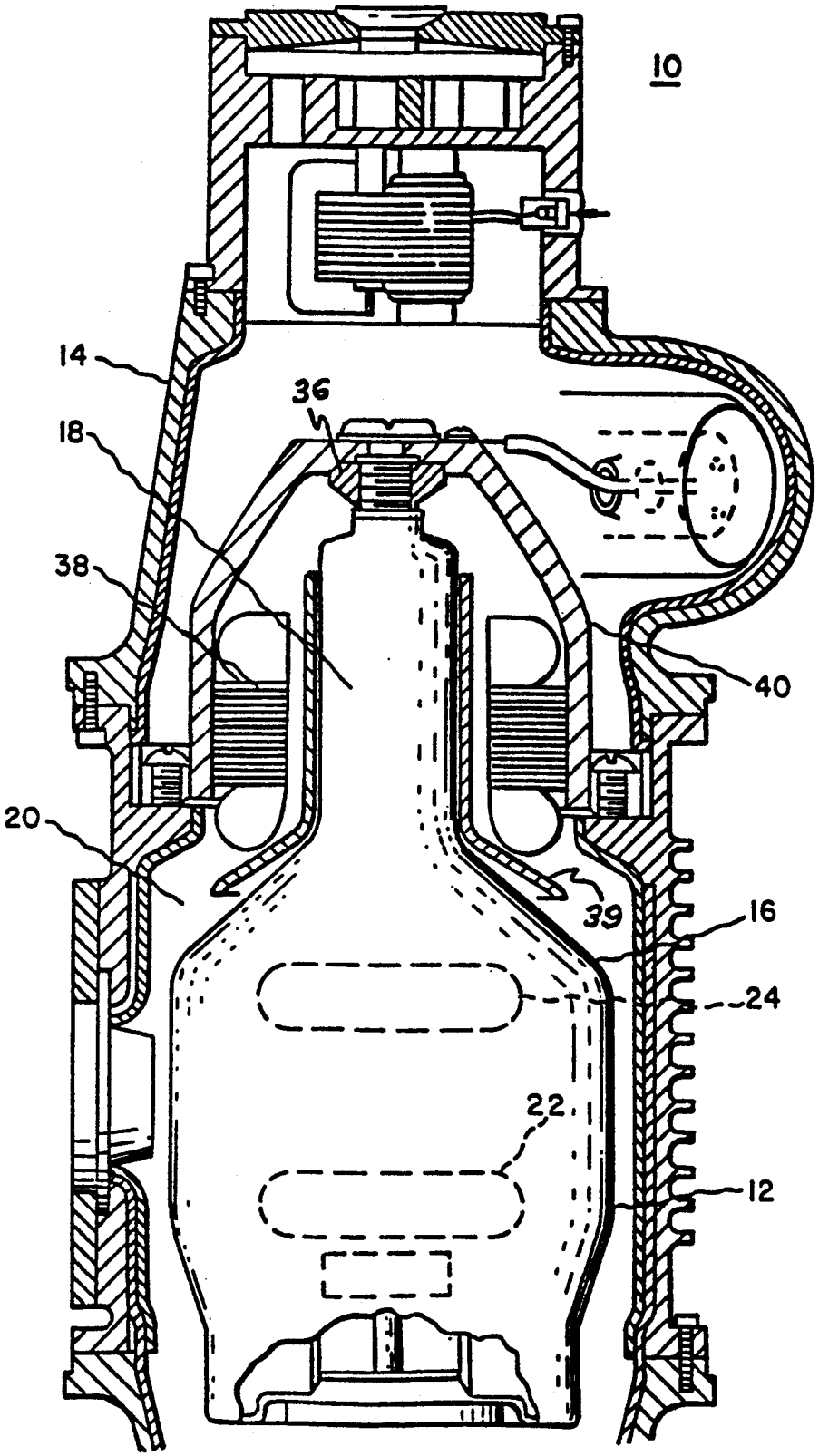
fig. 1 (PRIOR ART)
FIG. 1 shows a simplified side view cross-section of a conventional X-ray tube with some parts shown schematically.
Figure 2:
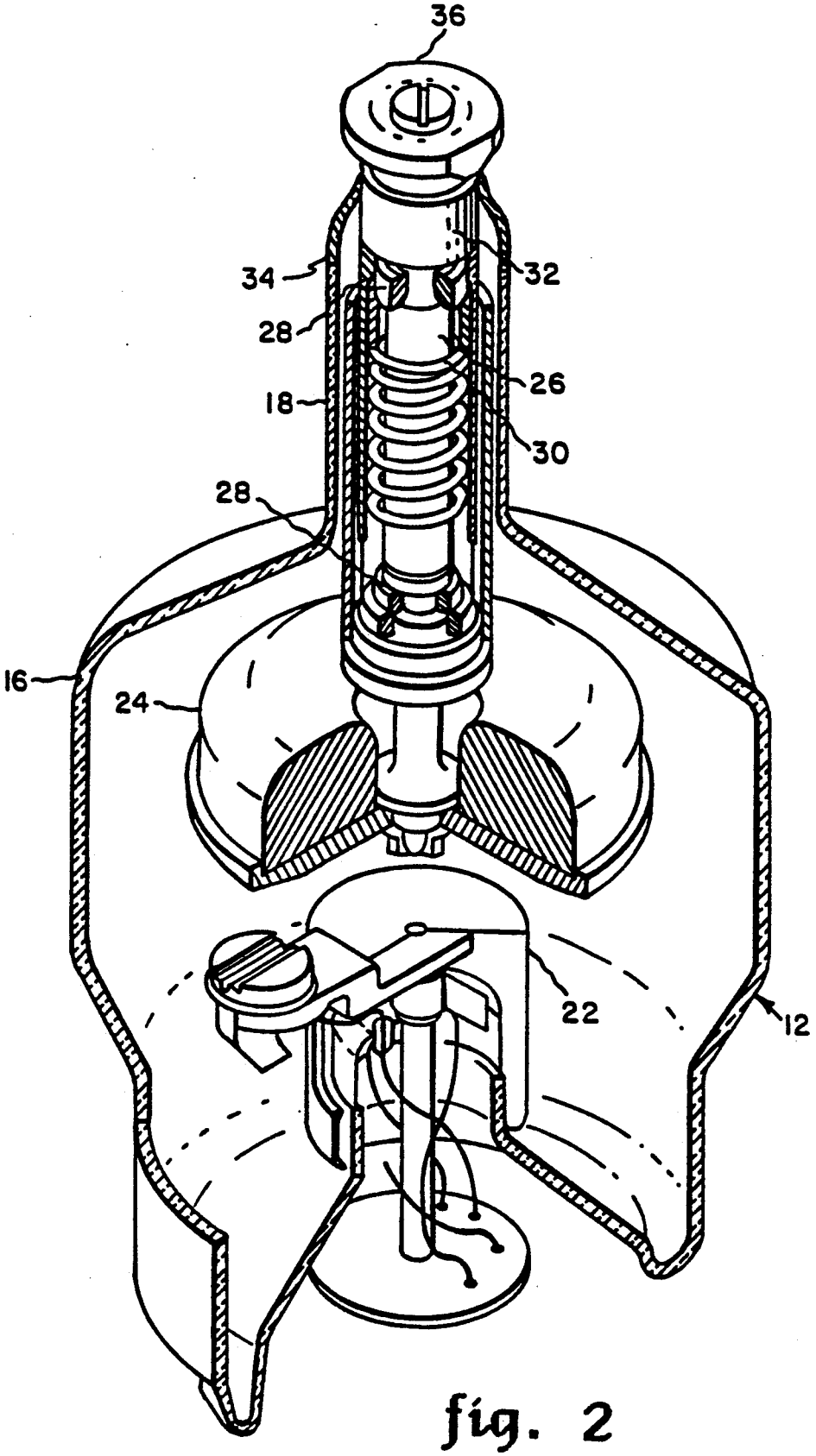
fig. 2 (PRIOR ART)
FIG. 2 shows a partially cut away perspective view of the vacuum tube of a conventional X-ray tube.

With reference to FIGS. 1 and 2, a conventional X-ray tube 10 having a vacuum tube 12 disposed within a casing 14 is shown. For ease of illustration, FIG. 2 shows the vacuum tube 12 removed from the casing. The vacuum tube 12 is a unitary member comprising a relatively large glass envelope or bell 16 and a narrow glass neck 18 joined together by a tapering junction section. The glass neck 18 extends outwardly from one end of the envelope 16. A chamber 20 between the vacuum tube 12 and the casing 14 is filled with an oil which provides cooling and dielectric functions.

Inside of the vacuum tube 12 is an electron emitter 22 and a target 24, both of which are shown schematically in FIG. 1. The electron emitter 22 emits electrons which strike the target 24 in order to generate X-ray energy in a known fashion.

Concentrating on the view of FIG. 2, the target 24 is mounted to a rotor 26 for rotation therewith. The rotor 26 has ball bearing assemblies 28 mounted at opposite ends thereof. A spring 30 is disposed between the ball bearings 28 and a rotor base 32 is disposed at one end of the rotor 26. A bearing shroud or interface member 34 extends from the distal end of the glass neck 18 to the rotor base 32, thereby connecting these elements. The interface member is a thin sleeve which is somewhat conical in shape and is generally made of an alloy material such as that which is commercially available under the trademark Kovar. This interface member 34 has thermal characteristics which reduce the chances that the diverse thermal characteristics of the base 32 and the glass neck 18 will cause cracking of the neck. A connecting piece 36 is disposed adjacent to the rotor base 32.

Referring again to FIG. 1, a stator member 38 is disposed around the glass neck 18 and serves to turn the rotor 26 (not shown in FIG. 1), thereby rotating the target 24. The stator 38 is spaced from the neck 18 to define a gap therebetween. A stator shield 39 is disposed in the gap between the stator 38 and the glass neck 18 in a spaced relationship from both the stator and the neck. The stator 38 is enclosed within a basket 40 which generally surrounds the neck 18. The vacuum tube is attached to the basket 40, and thus the casing 14, via the connecting piece 36.

It should be noted that the primary noise source of the X-ray tube is the bearing vibration resulting from the rotation of the rotor 26 and the associated components. The bearing vibration travels along a primary energy transmission path or circuit in which vibration is transmitted through the interface member 34 to the glass neck 18 which is strongly coupled to the interface member 34. If not repressed, the vibration will be transmitted from the neck 18 to the glass envelope 16. Because of its relatively large size, the envelope 16 is the primary source of further vibration transmission. Particularly, the vibration is readily transmitted from the glass envelope 16 to the casing 14 with little attenuation by the oil filling the chamber 20. The casing 14 converts the vibration to sound energy which is radiated to the ambient.

Figure 3:
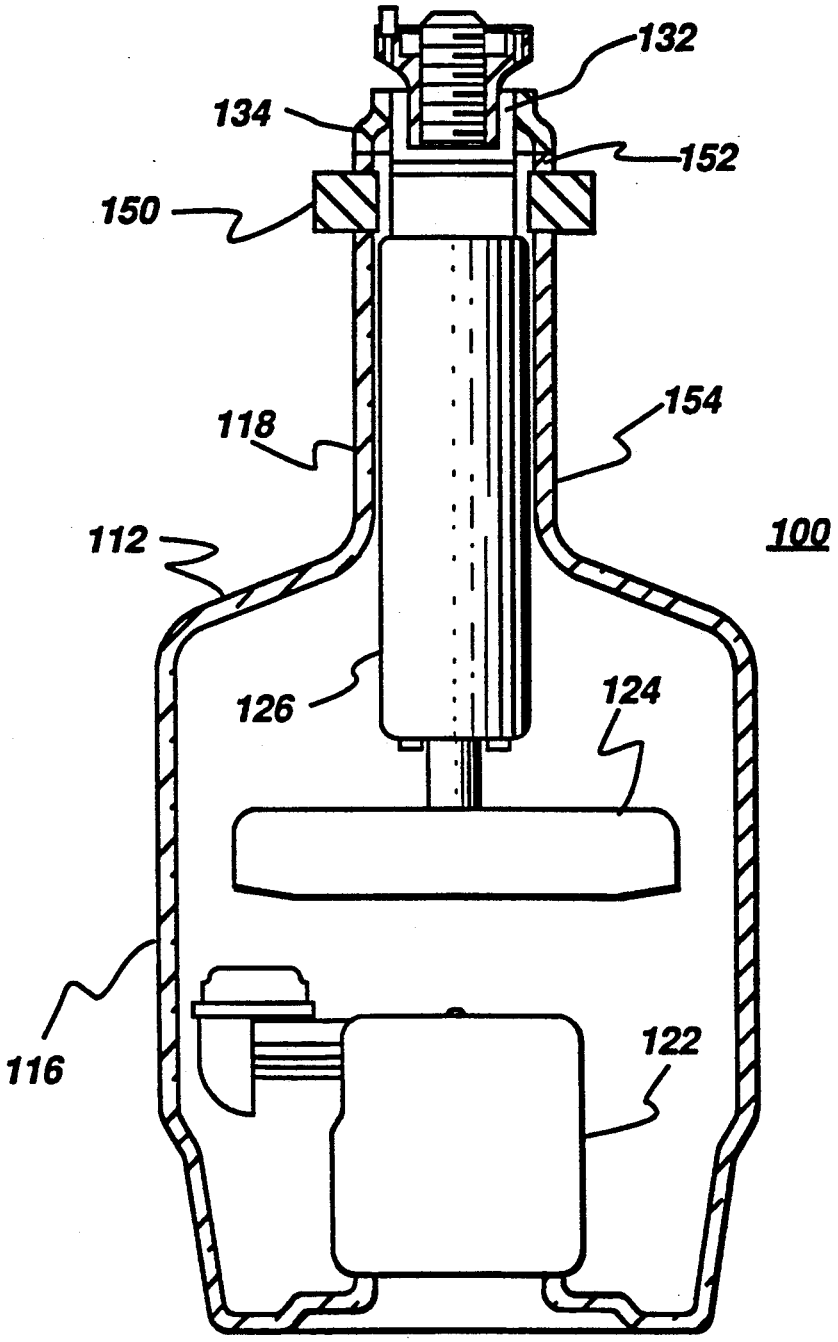
FIG. 3 shows a cross-section of a vacuum tube having a small diameter non-glass insert in accordance with one embodiment of the present invention.
Figure 4:
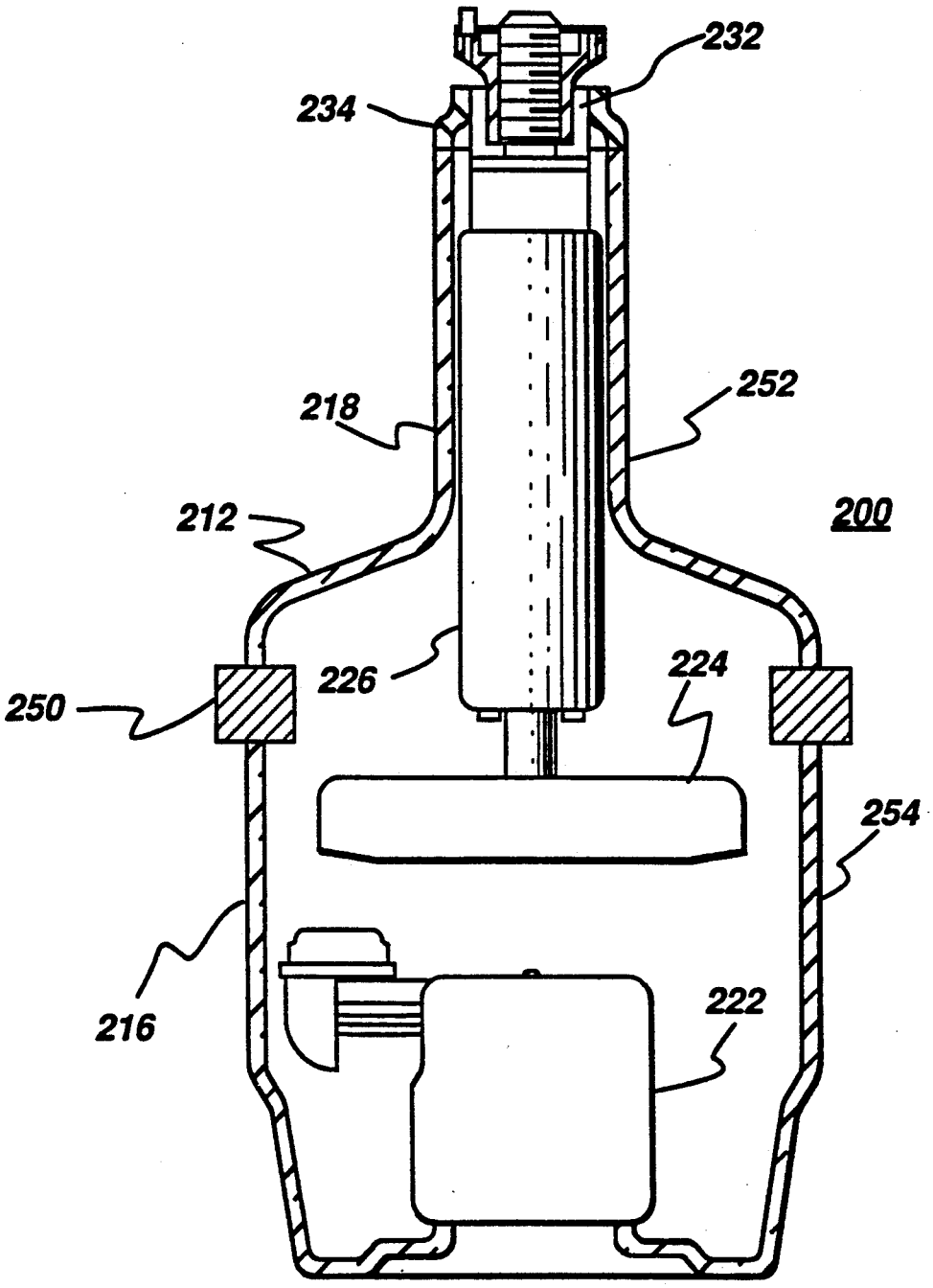
FIG. 4 shows a cross-section of a vacuum tube having a large diameter non-glass insert in accordance with another embodiment of the present invention.

Turning to FIGS. 3 and 4, two embodiments of the noise reducing arrangement of the present invention will now be described. FIG. 3 shows a cross-sectional view of an X-ray tube 100. The X-ray tube 100 is similar to the conventional X-ray tube described above in that it comprises a vacuum tube 112 disposed within a casing (not shown in FIG. 3). The vacuum tube 112 comprises a glass envelope 116 and a glass neck 118 extending outwardly from one end of the envelope. An electron emitter 122, a target 124 and a rotor 126 are disposed in the vacuum tube 112. A rotor base 132 is disposed at one end of the rotor 126. A bearing shroud or interface member 134 connects the end of the glass neck 118 to the rotor base 132. The elements of the X-ray tube 100 described above are essentially the same structure found in a conventional X-ray tube. Since these elements operate in a known fashion to generate X-ray radiation, they need not be described in further detail for a full understanding of the present invention.

The present invention achieves noise reduction through the provision of an insert 150. The insert 150 is a ring of non-glass material inserted into the glass vacuum tube 112. Thus, the vacuum tube 112 essentially comprises two glass sections 152 and 154 connected by the non-glass insert 150. This is different from conventional X-ray tubes in which unitary glass tubes are used. The conventional, unitary vacuum tubes are relatively light and have a thin, uniform material distribution which means that mobility is quite high. Thus, vibrational energy is readily transmitted throughout these conventional vacuum tubes. In the present invention, the non-glass insert 150 disrupts the uniform material distribution, thereby creating a hindrance to energy transmission. Since vibration is not readily transmitted past the insert 150, vibration introduced to the vacuum tube 112 at the distal end of the glass neck 118 via the interface member 134 is prevented from reaching the glass envelope 116. As mentioned above, it is from the relatively large envelope 116 that the bulk of vibration is transmitted to the casing where it is converted into noise.

FIG. 3 shows a small diameter embodiment of the non-glass insert 150 which is disposed near the distal end of the glass neck 118. In this case the tube 112 is divided into a small section 152 comprising the outermost portion of the glass neck 118 and a large section 154 comprising the entire glass envelope 116 and most of the neck 118. Alternatively, the insert 150 can be placed between the end of the neck 118 of the vacuum tube 112 and the interface member 134. This variation does not separate the vacuum tube 112 into two glass sections, but it prevents vibrations from being transmitted to the vacuum tube 112 from the interface member 134.

FIG. 4 shows a cross-sectional view of an X-ray tube 200 which has a second, large diameter embodiment of the non-glass insert. The X-ray tube 200 comprises a vacuum tube 212 disposed within a casing (not shown in FIG. 4). The vacuum tube 212 comprises a glass envelope 216 and a glass neck 218 extending outwardly from one end of the envelope and joined thereto by a tapering junction section. An electron emitter 222, a target 224 and a rotor 226 are disposed in the vacuum tube 212. A rotor base 232 is disposed at one end of the rotor 226. A bearing shroud or interface member 234 connects the end of the glass neck 218 to the rotor base 232.

The X-ray tube 200 has a non-glass insert 250 which is similar to the insert 150 of the FIG. 3 embodiment except that it is located in the glass envelope 216 very near the junction of the envelope and the glass neck 218 and has an accordingly larger diameter. By being positioned near the envelope-neck junction, the insert 250 divides the vacuum tube 212 into two sections 252 and 254. The first section 252 comprises the entire neck 118 and the tapering portion of the tube 212 joining the neck 218 to the envelope 216. The second section 254 comprises most of the glass envelope 216. This position prevents vibrational energy introduced at the neck 218 from being transmitted to the envelope 216.

Although two specific positions for a non-glass insert have been described, the present invention should not be so limited. The insert can be located anywhere in the vacuum tube as long as it prevents vibrational energy from being transmitted to the envelope section where it can be transmitted to the casing and converted into noise.

In order to provide effective vibration isolation, the insert should be made from a material having an impedance which is significantly different than the impedance of the glass sections of the vacuum tube. Particularly, the impedance difference between the insert and the glass should be on the order of about 2–4 orders of magnitude in MKS units. The impedance of a material is the density of the material multiplied by the speed of sound in the material and is an indication of the ability of a material to transmit sound or vibration energy therethrough. Vibration energy is readily transmitted between elements having similar impedances, while an impedance mismatch creates poor transmission. An impedance difference of 2–4 orders of magnitude in MKS units will provide an impedance mass that sufficiently blocks transmission of the vibration energy.

In addition to having a significantly different impedance, the non-glass insert material can be a material which is heavier than the glass material of the vacuum tube. If the non-glass insert has a significant weight or mass, then it will tend to dissipate vibration energy in addition to blocking transmission of the energy. Thus, a heavier non-glass insert will produce more vibration attenuation than an insert which merely creates an impedance mismatch. However, the heavier insert does increase the overall weight of the X-ray tube; a lightweight, impedance-mismatching insert has the advantage of reducing noise without increasing the overall weight. A full description of how attaching a mass to the vacuum tube dissipates vibration is given in the above-mentioned U.S. Pat. No. 4,935,948, which is hereby incorporated by reference.

Figure 5:
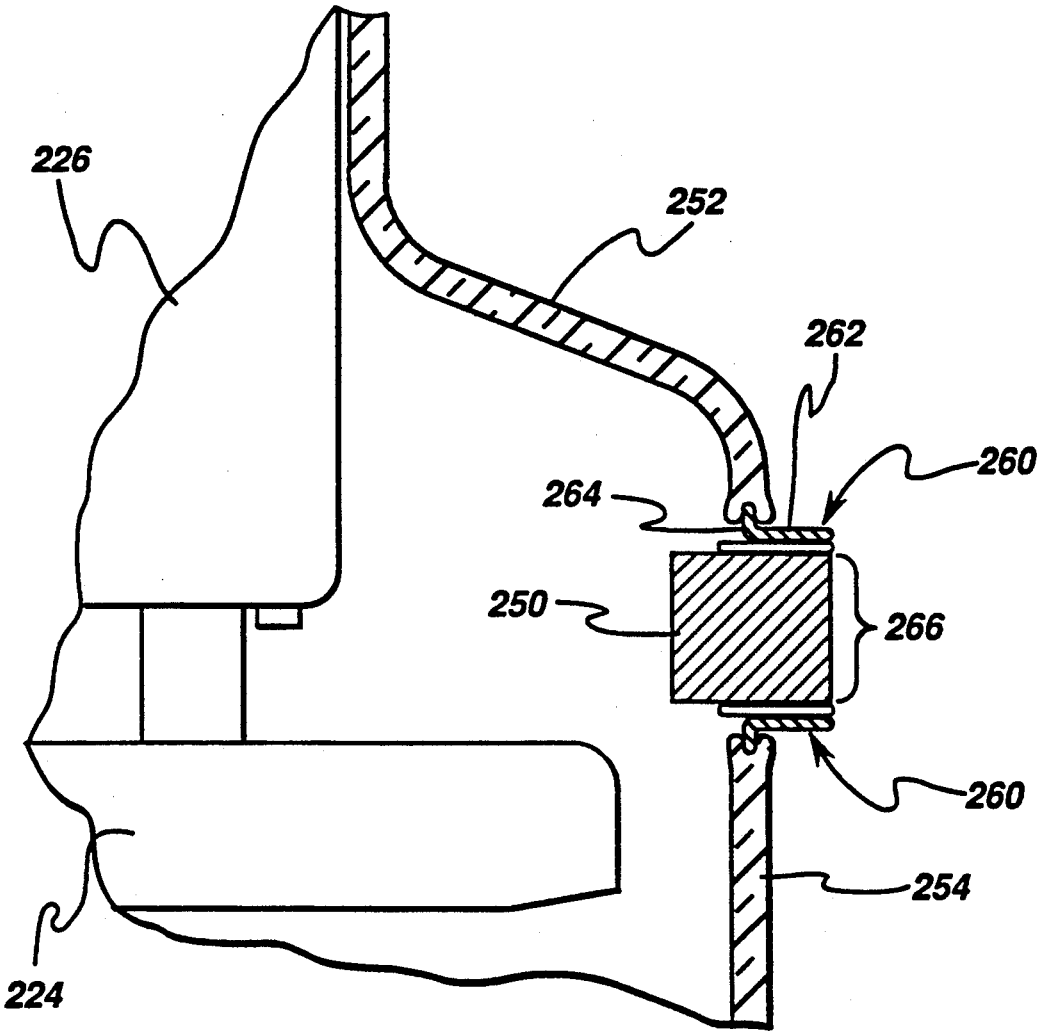
FIG. 5 is a partial cross-section view of a vacuum tube showing a connection of the non-glass insert in detail.
Figure 5A:
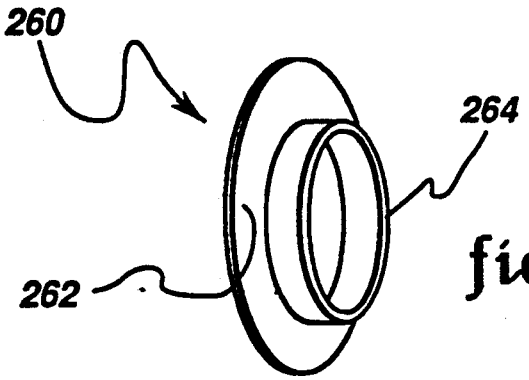
FIG. 5A shows a perspective view of a connecting element from FIG. 5.

FIG. 5 shows the connection between the non-glass insert and the two glass sections of the vacuum tube in detail. FIG. 5 particularly shows the connection between a large diameter insert 250 and the respective glass tube sections 252,254, but the same arrangement would be applicable to the connection of a small diameter insert to two glass tube sections. The connection is accomplished using a pair of connecting members 260. As best seen in FIG. 5A, each connecting member 260 comprises a ring 262 and an annular flange 264 extending perpendicularly from the ring 262. The diameter of the annular flange 264 of each connecting member 260 matches the diameter of the respective glass tube sections 252,254. Thus, the outer edge of the flange 264 is fitted into the glass material for a firm connection. Placing the flange 264 into the glass tube section positions the ring 262 of each connecting member 260 flush with the surface of the non-glass insert 250. The ring 262 is firmly affixed to the insert 250 as seen at reference numeral 266. Fixation can be accomplished by welding, adhesive or any other suitable known method. The connecting members are made from a material having sufficient mechanical strength and which closely matches the thermal expansion coefficient of the glass tube sections. An alloy material such as that which is commercially available under the trademark Kovar is preferred.

Figure 6:
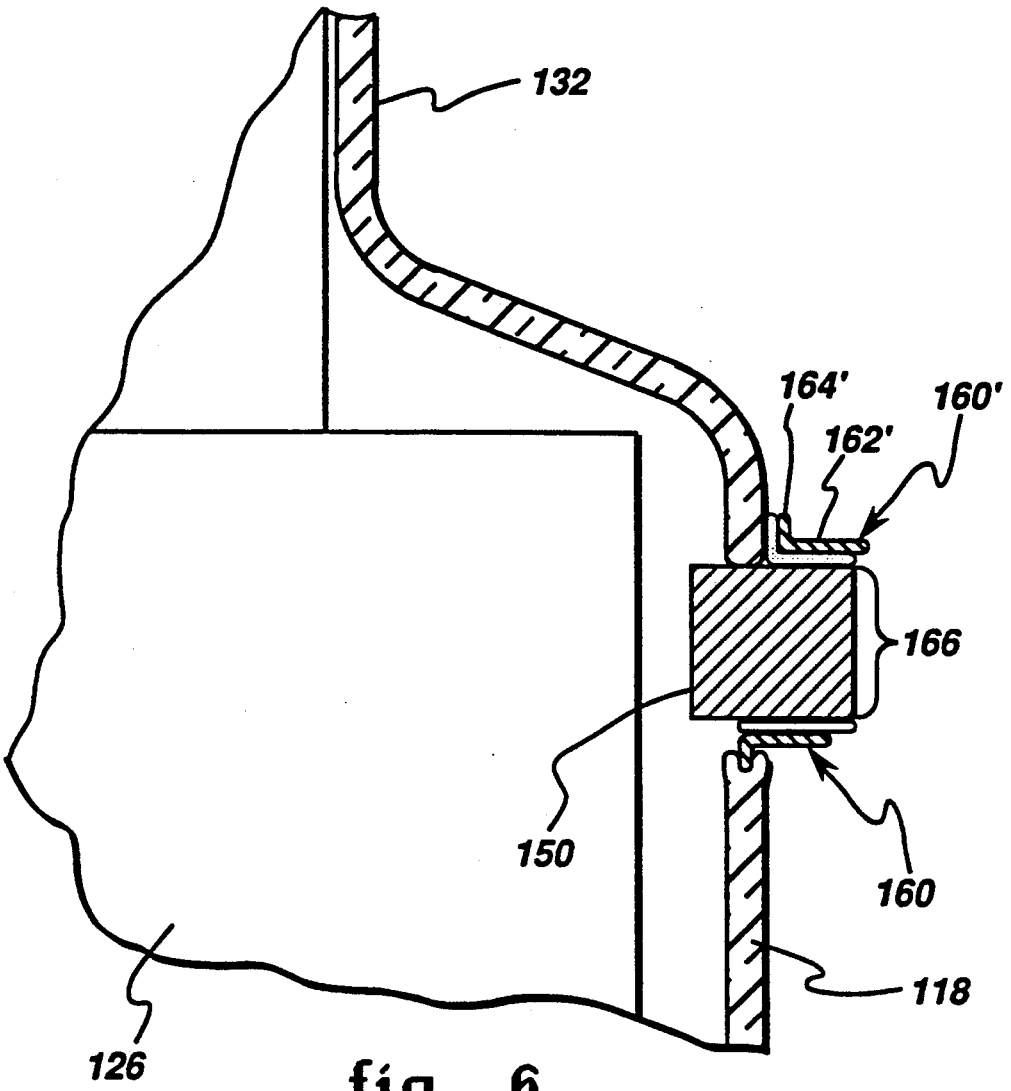
FIG. 6 is a partial cross-section view of a vacuum tube showing an alternative connection of the non-glass insert in detail.

FIG. 6 shows the connection of the non-glass insert for the alternative arrangement discussed above where the insert is situated between the end of the glass neck and the interface member. The connection of the insert 150 to the end of the glass neck 118 is accomplished with a connecting member 160 which is identical to the connecting member 260 discussed above except that it has a smaller diameter to accommodate the small diameter insert 150. The connecting member 160 is suitably affixed to the glass neck 118 and the insert 150. FIG. 6 also shows a modified connecting member 160' which connects the insert 150 to the interface member 134. The connecting member 160' comprises a ring 162' and an annular flange 164' extending perpendicularly from the ring 162' and is similar to the connecting member 160 except that the inside diameter of the flange 164' is slightly larger. Thus, the flange 164' fits over the outer surface of the interface member 132. The ring 162' and the flange 164' are affixed to the insert 150 and the interface member 132, respectively by known fixation methods, as shown at 166.

Figure 7:
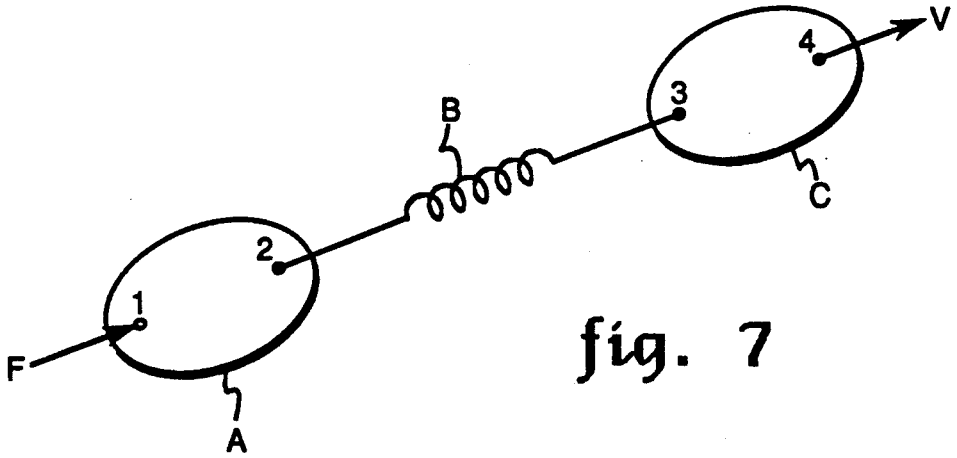
FIG. 7 shows a lumped parameter model of a vacuum tube of the present invention.

The effect produced by the non-glass insert can be predicted from a lumped parameter model of an X-ray tube of the present invention as shown in Figure 7. In the model, a first structural element A represents the first glass tube section 152,252, a connecting element B represents the non-glass insert 150,250 and a second structural element C represents the second glass tube section 154,254. As shown in the Figure, the connecting element B is attached to the first structural element A at point 2 and to the second structural element C at point 3. The vector F is a force acting on point 1; this represents the force due to the bearing vibration acting on the first glass element 152,252. The vector V is the vibration velocity response at point 4. Assume each element has a known mobility matrices. By definition, the mobility is the ratio of the velocity spectrum to the force excitation spectrum. The purpose of the model is to join each of the elements together to determine the overall system mobility. Comparison of the mobility with and without a non-glass insert will give the vibration transmission reduction effect.

The overall mobility function is not simply a product of the individual mobilities of the separate elements but also the mobilities of the connecting points. Therefore, the degree of coupling between the structures must be determined. The coupling loss factor, $\eta_1$, without a connecting element, i.e., with the first element A connected directly to the second element C, is given by:

$$\eta_1 = K\frac{G_aG_c}{(Y_a + Y_c)^2}$$

and the coupling loss factor, $\eta_2$, with a connecting element is given by:

$$\eta_2 = K\frac{G_aG_cY_b^2}{[Y_b(Y_a + Y_c) + Y_aY_c]^2}$$

where

K=constant factor, $Y_a$=transfer function mobility of element A, $Y_b$=mass mobility of element B, $Y_c$=transfer function mobility of element C, $G_a$=driving point mobility of element A, $G_c$=driving point mobility of element C.

The vibration transmission loss, TL, due to an inserted connecting element can be determined by:

$$TL = 10\log\frac{\eta_2}{\eta_1} = 10\log\frac{Y_b^2(Y_a + Y_c)^2}{[Y_b(Y_a + Y_c) + Y_aY_c]^2}.$$

Prediction of the vibration transmission loss from the above equation requires three data inputs: $Y_a$, $Y_b$, and $Y_c$. $Y_a$ and $Y_c$ can be directly measured from the separate structures, and $Y_b$ can be evaluated by:

$$Y_b = \frac{1}{j\omega M}$$

where

M=mass of element B, $\omega$=radial frequency, $$j = \sqrt{-1}.$$

Figure 8A:
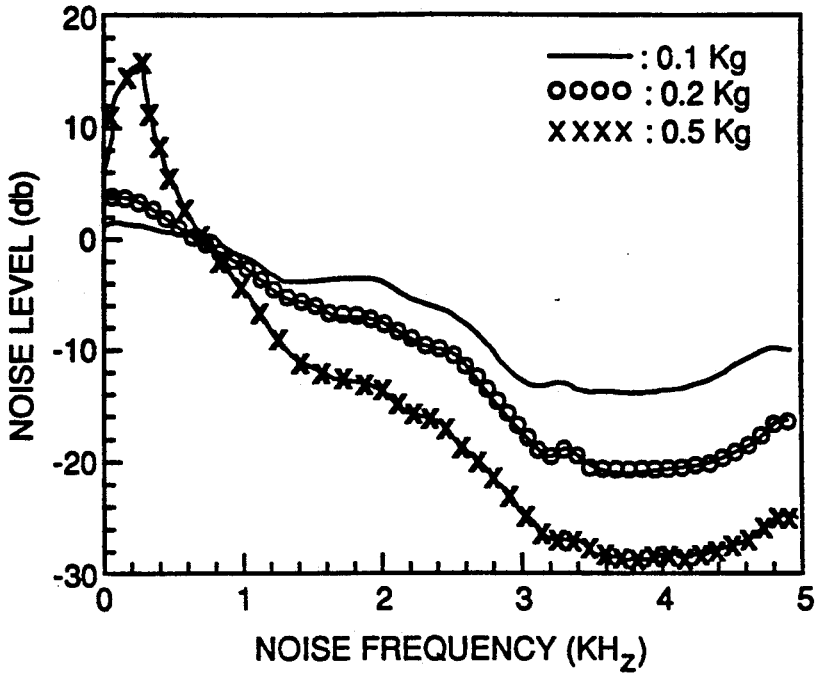
FIGS. 8A and 8B show graphs plotting predicted noise reduction levels against noise frequency for a small diameter non-glass insert and a large diameter non-glass insert, respectively.
Figure 8B:
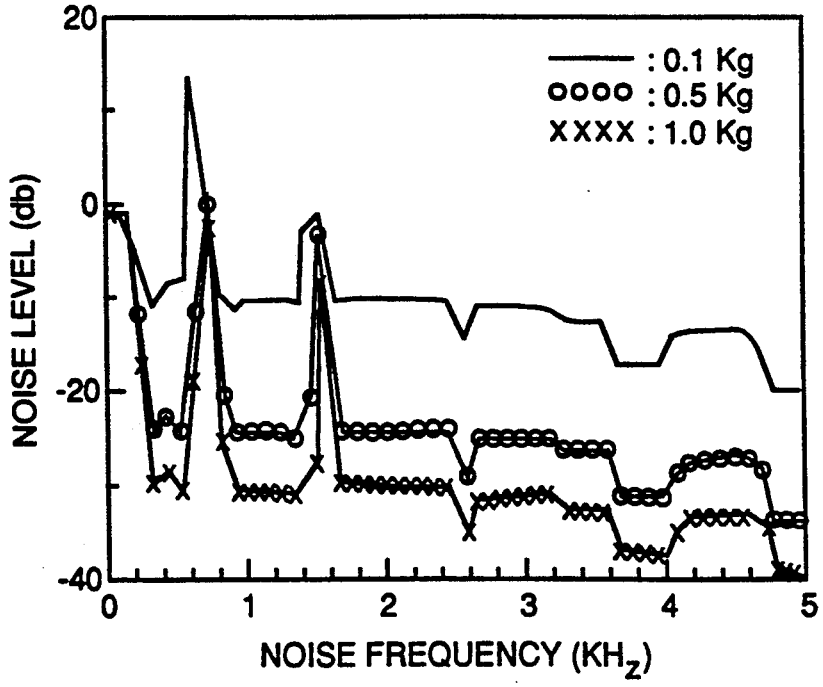

FIGS. 8A and 8B show predicted vibration noise reduction levels based on transmission loss values determined from the above equations. FIG. 8A shows noise reduction in decibels plotted against noise frequency in kilohertz for a small diameter non-glass insert as shown in FIG. 3. Results were predicted for inserts weighing 0.1 Kg, 0.2 Kg, and 0.5 Kg. FIG. 8B shows the results for a large diameter insert as in FIG. 4 for insert weights of 0.1 Kg, 0.5 Kg, and 1.0 Kg. As expected, these results show that heavier inserts provide greater levels of noise reduction.

Various ancillary noise reduction means are available to supplement the noise reduction provided by a non-glass insert. For instance, the casings of conventional X-ray tubes usually include a lead lining as an X-ray shield. The lead lining and casing wall have similar impedance characteristics so vibration is easily transmitted. Disposing a soft foam substance between the lead lining and the casing wall creates an impedance mismatch and hinders further transmission of any vibration which may be transmitted past the non-glass inserts. The foam is provided in the regions immediately surrounding the large envelope portion of the vacuum tube. These locations are the most sensitive to vibration energy transmitted from the vacuum tube. Another ancillary means of noise reduction is to replace the typical ball bearings with needle bearings. The needles are cylindrical members which have a large length-to-diameter ratio so that contact pressure is reduced and rolling friction is low. Due to the extended length of the needles, a needle bearing is less sensitive to the centrifugal force created by the heavy target rotating at a high speed. Thus, the needle bearing can generally reduce the amount of bearing vibration initially generated.

The foregoing has described a non-glass insert for glass vacuum tubes in X-ray tubes. The insert provides an impedance discontinuity which reduces vibration transmission through the vacuum tube. In addition, if it has a sufficient mass, the insert can even dissipate vibrational energy.

While specific embodiments of the present invention have been described, it will be apparent to those skilled in the art that various modifications thereto can be made without departing from the spirit and scope of the invention as defined in the appended claims.

What is claimed is:

1. A vacuum tube comprising:

first and second sections; and an insert member located between said first and second sections, said insert member having an impedance significantly different than the impedance of either of said first and second sections to inhibit transmission of vibration energy between said first and second sections.

2. The vacuum tube of claim 1 wherein said insert member has an impedance about 2–4 orders of magnitude different than the impedance of either of said first and second sections.

3. The vacuum tube of claim 1 wherein said insert member is made of a heavier material than either of said first and second sections.

4. The vacuum tube of claim 1 wherein said insert member is connected to said first and second sections by a respective connecting member, each said connecting member having a coefficient of thermal expansion which closely matches the coefficient of thermal expansion of said sections.

5. The vacuum tube of claim 4 wherein each said connecting member comprises a ring having an annular flange extending perpendicularly therefrom.

6. The vacuum tube of claim 5 wherein the ring of each connecting member is attached a respective one of said first and second sections and the flange of each connecting member is attached to said insert member.

7. A vacuum tube for an X-ray tube comprising:

first and second sections; and an insert member connecting said first and second sections, said insert member having an impedance significantly different than the impedance of either of said first and second sections to inhibit transmission of vibration energy between said sections.

8. The vacuum tube of claim 7 wherein said insert member has an impedance about 2–4 orders of magnitude different than the impedance of either of said first and second sections.

9. The vacuum tube of claim 7 wherein said insert member is made of a heavier material than either of said first and second sections.

10. The vacuum tube of claim 7 wherein said insert member is connected to said first and second sections by a respective connecting member, each said connecting member having a coefficient of thermal expansion which closely matches the coefficient of thermal expansion of said sections.

11. The vacuum tube of claim 10 wherein each said connecting member comprises a ring having an annular flange extending perpendicularly therefrom.

12. The vacuum tube of claim 11 wherein the ring of each connecting member is attached a respective one of said first and second sections and the flange of each connecting member is attached to said insert member.

13. An X-ray tube comprising:

a casing;

a vacuum tube disposed in said casing, said vacuum tube comprising at least two sections; and a vibration inhibiting member disposed between said at least two sections, said vibration inhibiting member having an impedance which is significantly different than the impedance of the vacuum tube.

14. The X-ray tube of claim 13 wherein said vibration inhibiting member has an impedance about 2–4 orders of magnitude different than the impedance of either of said at least two sections.

15. The X-ray tube of claim 13 wherein said vibration inhibiting member is made of a heavier material than either of said at least two sections.

16. The X-ray tube of claim 13 wherein said vibration inhibiting member is connected to each of said at least two sections by a respective connecting member, each said connecting member having a coefficient of thermal expansion which closely matches the coefficient of thermal expansion of said at least two sections.

17. The X-ray tube of claim 16 wherein each said connecting member comprises a ring having an annular flange extending perpendicularly therefrom.

18. The X-ray tube of claim 17 wherein the ring of each connecting member is attached a respective one of said at least two sections and the flange of each connecting member is attached to said vibration inhibiting member.

19. An X-ray tube comprising:

a casing;

a glass tube disposed in said casing and comprising an envelope portion and a neck portion extending from the envelope portion; and a non-glass insert directly attached to said glass tube, said non-glass insert inhibiting transmission of vibration energy to said envelope portion.

20. The X-ray tube of claim 19 wherein said insert is directly attached to the distal end of said neck portion.

21. The X-ray tube of claim 19 wherein said insert is located in said neck portion, near the distal end of said neck portion.

22. The X-ray tube of claim 19 wherein said insert is located in said envelope portion, near the junction between said envelope portion and said neck portion.

* * * * *